US009216574B2

(12) United States Patent
Tunnicliffe-Wilson et al.

(10) Patent No.: US 9,216,574 B2
(45) Date of Patent: Dec. 22, 2015

(54) PRINT GAP COMPENSATION

(75) Inventors: Stephen George Tunnicliffe-Wilson, Cambridge (GB); Adam Woolfe, Cambridge (GB); Stephen Douglas, Cambridge (GA); Nicholas John Campbell, Cambridge (GB)

(73) Assignee: Inca Digital Printers Limited (GB)

( * ) Notice: Subject to any disclaimer, the term of this patent is extended or adjusted under 35 U.S.C. 154(b) by 0 days.

(21) Appl. No.: 14/126,081

(22) PCT Filed: Jun. 15, 2012

(86) PCT No.: PCT/GB2012/051378

§ 371 (c)(1),
(2), (4) Date: Jan. 7, 2014

(87) PCT Pub. No.: WO2012/172359

PCT Pub. Date: Dec. 20, 2012

(65) Prior Publication Data

US 2014/0184682 A1 Jul. 3, 2014

(30) Foreign Application Priority Data

Jun. 15, 2011 (GB) ..... 1110107.8

(51) Int. Cl.
*B41J 29/393* (2006.01)
*B41J 2/125* (2006.01)
(Continued)

(52) U.S. Cl.
CPC ..... *B41J 2/125* (2013.01); *B41J 19/202* (2013.01); *B41J 25/308* (2013.01)

(58) Field of Classification Search
CPC ..... B41J 2/125; B41J 25/308; B41J 25/3086; B41J 11/20; B41J 11/0035
USPC ..... 347/19
See application file for complete search history.

(56) References Cited

U.S. PATENT DOCUMENTS 5,308,974 A 5/1994 Elings et al.
2003/0043246 A1 3/2003 Codos
(Continued)

FOREIGN PATENT DOCUMENTS

EP 1029698 A2 8/2000
GB 2037464 A 7/1980
(Continued)

OTHER PUBLICATIONS

International Written Opinion for Application No. PCT/GB2012/051378 dated Nov. 7, 2012.
(Continued)

*Primary Examiner* — Geoffrey Mruk
*Assistant Examiner* — Scott A Richmond
(74) *Attorney, Agent, or Firm* — Lerner, David, Littenberg, Krumholz & Mentlik, LLP

(57) ABSTRACT

In an ink jet printer (2), where there is relative movement between a print carriage (4) and a print table (6) to print on to a substrate mounted on the table (6), the gradient of the print table at each position of the print carriage (4) is used to produce a compensated position of the print carriage (4), and printing data is sent to the print head according to the compensated position instead of the actual position. This delays or advances the release of ink, to compensate for the difference in the time taken for the ink to reach a substrate mounted on the print table (6) when the print gap between print heads and print table (6) is not constant.

14 Claims, 4 Drawing Sheets

(51) Int. Cl.
*B41J 19/20* (2006.01)
*B41J 25/308* (2006.01)

(56) References Cited

U.S. PATENT DOCUMENTS

| | | | | |
|---|---|---|---|---|
| 2003/0206304 | A1 | 11/2003 | Davis et al. | |
| 2004/0027583 | A1 | 2/2004 | Dulman | |
| 2004/0090475 | A1* | 5/2004 | Ioka et al. | 347/5 |
| 2007/0070099 | A1* | 3/2007 | Beer et al. | 347/8 |
| 2010/0121477 | A1* | 5/2010 | Jonas et al. | 700/121 |
| 2010/0231635 | A1* | 9/2010 | Ramakrishnan et al. | 347/19 |

FOREIGN PATENT DOCUMENTS

| | | |
|---|---|---|
| JP | 60225763 | 11/1985 |
| JP | 2004061322 A | 2/2004 |

OTHER PUBLICATIONS

International Search Report for Application No. PCT/GB2012/051378 dated Nov. 7, 2012.

Search Report for Application No. GB 1110107.8 dated Feb. 10, 2012.

* cited by examiner

*Fig. 2* Encoder Compensation Scheme
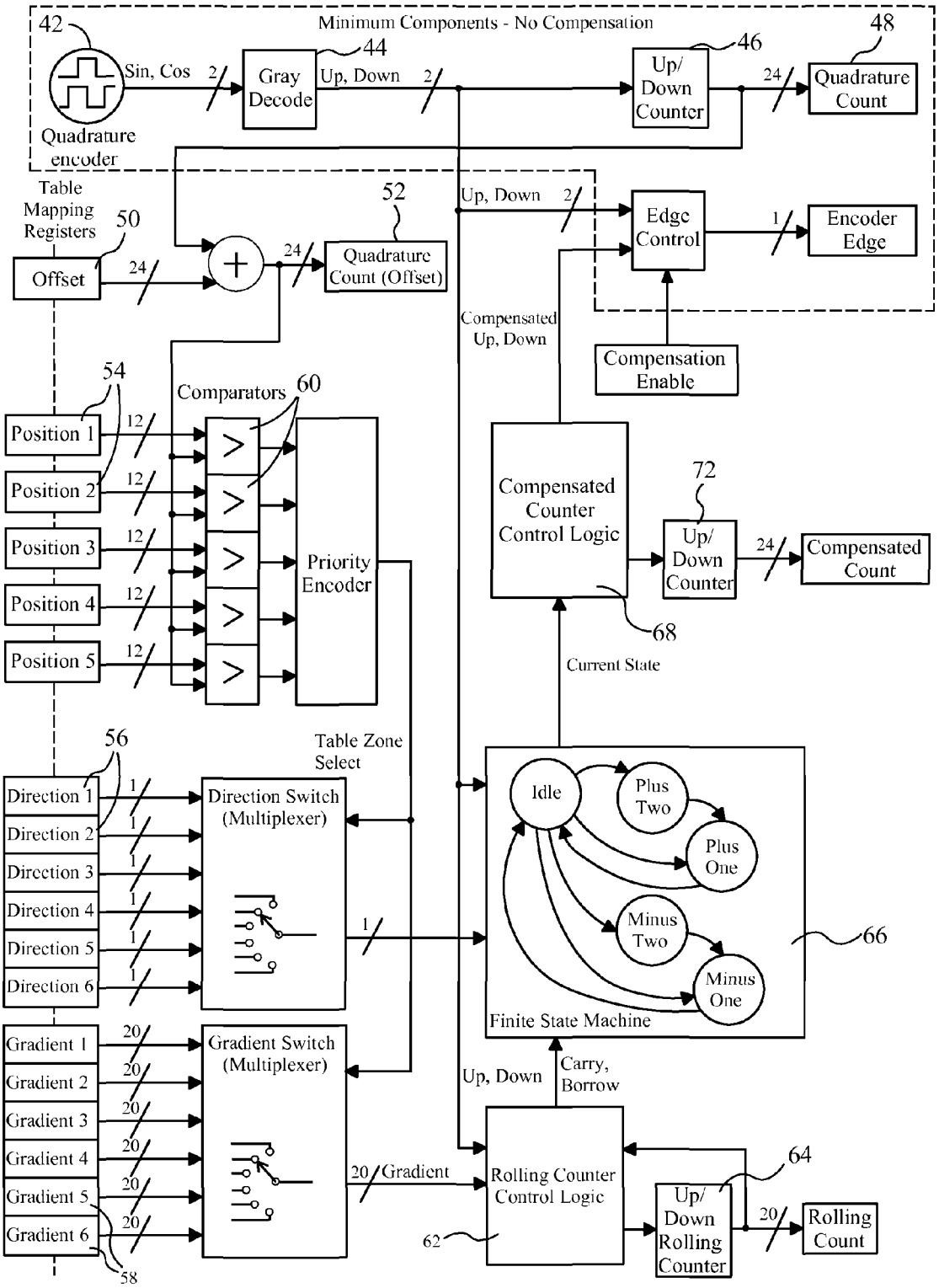

PRINT GAP COMPENSATION

This invention relates principally to compensating for variations in the print gap in an ink jet printer, although some novel techniques disclosed herein have wider applicability.

Ink jet printers produce an image on a substrate by 'firing' ink droplets from nozzles provided on a print head as the print head traverses the substrate. Commonly the substrate is supported on a surface such as a print table, and the print head is mounted on a carriage which moves back and forth across the width of the substrate printing a line or swathe of ink with each pass to build up the required printed image. Movement in an orthogonal direction may be by moving a carrier of the print carriage. Alternatively the print head is caused to traverse the substrate by moving the print table (or other assembly which supports the medium such as rollers) under the print heads, or a combination of movement of the heads and table; references herein to a print head traversing a substrate are intended to encompass any arrangement which produces relative movement, whether by movement of the carriage or table or both.

In such printers, variations in the gap between the print head and the substrate, known as the 'print gap', can cause defects in the printing. In practice, the print gap will not be constant due to factors such as variations in the substrate thickness, distortions in the substrate support, in the case of a table typically due to thermal effects and inaccuracies in the print head transport system. A particular issue the invention deals with is that a print table, even if manufactured and adjusted within close tolerances, tends to deform as the temperature changes during use, but the invention can address problems with other support mechanisms.

When printing with inkjet, the position in which the ink droplet lands on the substrate, relative to the point of release from the print head, is affected by the droplet velocity, the speed of the print heads relative to the substrate and the gap between print heads and substrate. Therefore if the print gap is not constant, then the time taken for the ink to reach the substrate from a nozzle of a print head will vary over the area of the table. Where the print head is moving across the substrate, and thus the ink droplet is travelling along an inclined trajectory, this variation can result in small errors in the position in which each droplet of ink deposited. This is particularly important in bi-directional printing, where variations give double images or "fuzzy" text. However, even for unidirectional printing the placement accuracy may be important, for example in non-graphics inkjet applications, such as materials deposition in flat panel displays.

This is also a particular problem in large printers, where the print table has a large area compared to the print gap, distortions due to thermal expansion may be significant, and the print head and substrate move relative to each other at a high speed. Whilst previous methods have attempted to adjust the table surface, small variations in the flatness of the table and/or distortions occurring during use may be difficult to avoid.

Furthermore, there may be a requirement to print an image onto a substrate which is not flat; for example when printing an image onto a textured surface or a shaped article, such as a wood-grain pattern onto a moulded door. If a simple image is printed onto such substrates, small discontinuities or distortions of the image may occur.

The present invention aims to provide a method of printing which compensates for such variations in the print gap.

Thus the invention provides, according to one aspect, a method of providing a working measure of the topography of a work surface comprising storing at least first and second representations of the topography corresponding respectively to first and second conditions, and obtaining the values of at least one parameter associated with each of the first and second conditions, and providing the working measure based on a working value of the parameter and the stored representations of the topography.

The working measure of the topography of the work surface is preferably not an absolute measure of the variation in height of the work surface relative to a planar surface, but is a measure of the variation over the surface of the gap between the surface and a work head that moves over the surface. In a printer, this gap would be the print gap between the substrate and the printhead. Hence factors other than distortion of the work surface can be taken into account in the working measure of the topography. These factors may include distortion and inaccuracies in the work head transport system, variations in the substrate thickness and distortions in the substrate support.

It has been found that, surprisingly, although imperfections and deformities in a work surface, particularly one which is intended to be flat and which is typically constrained at several points, may be complex and difficult to predict in absolute terms, and may vary between measurements, variation over typical operating ranges may be usefully characterised by one or only a few parameters, typically a measure of temperature or of deflection at one point, or a relatively small number of points, on the substrate table.

In this way local values of a work surface height or deflection may be obtained simply without the need for multiple direct measurements when the topography is changing with conditions such as temperature variation. The stored representations may comprise detailed height maps of stored measurements or may comprise simplified models, for example fitting measured values of height values to one or more curves or series of straight lines.

In a preferred embodiment, the working measure is provided to a control system for an ink jet printer comprising at least one print head and is used to control the timing of the release of ink from a print head.

When the ink jet printer comprises a plurality of print heads, the timing of the release of ink from each print head may preferably be controlled individually. As set out in more detail below, this may be particularly advantageous in a full width array printer where the print head array spans a large distance and the compensation for variations in the print gap that is required at one end of the array is different to that required at the other end of the array.

In one embodiment, the work surface comprises a print substrate or a substrate support. Variations in the topography may be a result of unevenness in the print substrate or in the substrate support, such as the print table.

Preferably, the working measure of the topography of the work surface comprises a measure of a print gap between the work surface and a printhead.

According to a preferred embodiment, the working measure of the topography comprises a measure of a variation in height over a two-dimensional area.

In this embodiment, the working measure of the topography of the work surface may be used to create a two dimensional array of compensation values. These values can then be applied to a work head traversing the work surface.

Preferably, the compensation values comprise timing compensation values for controlling the operation of a print head traversing the work surface. These timing compensation values may be used, for example, to vary the timing of the release of ink from the print head.

The working value of the parameter may be a measured value such as a measure of temperature, a derived value such as a measure of energy flux, or an input value such as a measure of operation time.

The representations of topography may be obtained by taking measurements of the work surface at one or more reference locations, and modelling the topography based on interpolation between the measurements or an approximation using stored coefficients of characteristic curves. Such coefficients may be obtained by calculating the best fit between the measurements. It has for example been found that thermal expansion of a print table tends to give a constant radius of curvature relative to the table centre.

Interpolation may also be used between the stored representations of the topography for different values of the parameter, which interpolation may be linear or non-linear or based on an intermediate measure. The topography may also be modelled as a stored function of the parameter.

The value of the at least one parameter may be obtained for different regions of the work surface, and interpolation may be carried out between the regions. Thus for example if one region of the work surface is at a higher temperature than another, a more accurate topography may be obtained.

The working measure of topography may be used to provide the local measure of print gap in an ink jet printer according to the first aspect of the invention.

In a preferred embodiment, each representation of the topography is obtained by: printing a calibration image onto the work surface, or onto a print substrate covering the work surface; analysing the printed calibration image to compare the printed calibration image to an expected image; and calculating a variation in the topography of the work surface based on a difference between the printed calibration image and the expected image.

Preferably, printing a calibration image comprises printing a plurality of calibration images using a printhead arranged at a plurality of heights from the work surface.

Preferably, the calibration image is printed in a plurality of different colours.

According to a further aspect, the present invention provides a method of printing with an ink jet printer comprising, as the print head traverses the print area, varying the timing of the release of ink from the print head based on a local measure of the print gap.

Therefore the timing of the release point may be adjusted throughout the print, so that the droplets of ink land close to the required position even though the gap between the print heads and the substrate is changing.

Whilst the absolute size of the print gap could be used to determine the timing of ink release, conveniently the timing is varied based on the rate of change of the local measure of the print gap along the printing direction. Thus the ink droplets may be released from the nozzles of the print head either earlier or later depending upon whether the print gap is increasing or decreasing, such that they reach a substrate mounted on the print table at substantially the same spacing as if the table were flat. Therefore the print quality may be improved.

Commonly, the print head traverses the print area in a printing direction sequentially along a plurality of printing lines. Preferably the method comprises obtaining a measure of the print head position in at least the printing direction using an encoder arranged to generate a sequence of pulses as the print head traverses the print area, wherein varying the timing of ink release is effected by processing the encoder pulses.

This method has the advantage of requiring minimal adjustment to existing electronic systems in the printer, which can receive and use the processed encoder pulses in the usual manner, since the timing of the pulses has been changed to compensate for changes in the print gap. Furthermore, there is no need to carry out complex processing of the image data.

Preferably, the method includes varying the timing based on the rate of change of the local measure of the print gap across the print area in two dimensions along the printing direction and in a direction perpendicular to the printing direction.

Conveniently the method comprises using the local measures of the print gap to obtain a timing compensation value representative of the rate of change of the print gap. For example the compensation value may have a size dependent upon the gradient or slope of the print gap, and a sign representative of the direction of the slope. This value can be applied to the encoder pulse to add or delete pulses depending upon the sign of the compensation value at a rate dependent upon the size of the compensation value. This provides a simple method of processing the encoder pulses.

Preferably the encoder pulses have a finer granularity than the print resolution such that alteration of the encoder pulses may be used to effect very small changes in the position of an ink droplet. Thus an encoder pulse may correspond to less than half or less than a quarter of the width of the ink droplet spacing, and preferably about a tenth of the droplet spacing. For example, if the print resolution is 1200 dpi, giving an ink droplet spacing of about 20 microns, the encoder may produce about twenty pulses to each droplet spacing, giving a pulse for every 1 micron across the print direction. In contrast, whilst compensation could be carried out by distorting the data representing the image to be printed by moving the pixels within it, this technique would be limited to a resolution of one print grid pixel. If it is desired to use correction, the image may be over-sampled, for example the image may be upsampled to a virtual print resolution of say 2400 dpi and a correction applied to the upsampled image to give half pixel correction; this requires more processing for each image but on the other hand this can be achieved in software if the existing hardware can support the resolution.

Preferably the method comprises obtaining a compensation value by measuring the print gap and comparing the measurement with a measurement of the print gap at an adjacent position along the printing direction. The print gap may be measured by measuring the height of the print table or substrate, or the distance between the print table or substrate and the print carriage or print head.

The method preferably comprises storing a series of timing compensation values for various positions over the print area, preferably storing a two-dimensional array of timing compensation values for a plurality of positions over the print area. Interpolation may be used to provide intermediate values. The compensation values may be derived by scanning the print table or the substrate to be printed, or from printing and analysing (by examination using a scanner or by direct visual inspection) a calibration image or test pattern, or a combination.

The scan may comprise measuring the print gap at a plurality of positions over the area of the print table or substrate, to produce a 'map' of the topography. The gap data may then be simplified to provide an approximation of the rate of change of the print gap by approximating the gap along the printing direction as a plurality of regions of constant slope for each line of printing, using known methods. For example, five slope regions across the width of the table have been found to give sufficient accuracy for typical variations in a printer table having a width in the region of about two meters.

Preferably, a model of print gap variation across the print area may be stored and the local measure of the print gap may be provided as a function of the position of the print head.

In one embodiment, a model of print gap variation across the print area may be stored for each of a plurality of values of at least one parameter, and the local measure of the print gap may be provided dependent upon an input or measured value of the or each parameter. The parameter may comprise at least one of temperature, humidity, energy flux and operation time, or may be a combination of these factors.

Alternatively, the measurements of the print gap may take place in real time as printing is taking place (or near-real-time, for example on a scanning pass before a printing pass, or on a prior printing pass), for example using a camera or other sensor mounted on the print carriage. If measurement takes place during printing, the method has the additional advantage that it may be used to compensate for any distortion of the print table which may take place during printing.

In some applications, the print gap height variation may be a known function of position and/or time, for example where the print table is caused to distort due to thermal expansion which takes place as the printer heats up during use. Thus the local measure may be calculated or derived from a parameter or parameters which characterise the distortion, for example from a measure of the print gap at a particular reference position, and/or from a measure of temperature or operation time or energy flux into the print table.

Thus the compensation value at a particular position may be obtained from stored data using a simple look up table, or by using a comparator where the data comprises compensation regions. Where the compensation value indicates that the print gap is decreasing, the release of ink is delayed, and vice versa. This may be achieved by using the compensation value to provide a compensated position for providing print data to the print head. Thus print data is provided to the print head for releasing ink as if it were in a position either slightly ahead of or slightly behind the actual position. This is a simple and effective way of compensating for the difference in the print gap.

Where the print head traverses back and forth across the print area, the encoder processing as described above may result in the image length being shorter in terms of encoder pulses in one direction than the other, since a given slope in the print gap will result in pulses being added in one direction and deleted in the other. To facilitate processing, the encoder pulse sequence preferably is arranged to provide an edge count having a small positive value at the start of the image (rather than zero), preferably exceeding the largest count to be subtracted This makes it straightforward in hardware or software to add or delete counts in order that the image data remain in correct registration, without counters needing to cycle through zero.

In one embodiment, the ink jet printer comprises a plurality of print heads and the timing of the release of ink from each print head in the plurality of print heads is individually controlled.

The ink jet printer may comprise a full width array printer comprising a plurality of print heads. In this embodiment, the timing of the release of ink from each print head may be dependent on the position of the print head within the full width array.

In an alternative embodiment, the ink jet printer may comprise a scanning printer comprising a printer carriage that moves in a print direction across the print area. In this embodiment, the timing of the release of ink from the print head is dependent on the position of the printer carriage in the print direction.

A further aspect of the invention further provides a method of calibrating a print table comprising deriving compensation data by scanning the print table to measure variations in the height of the table, and calculating compensation values based on the variations, such as the rate of change of the table height in the printing direction.

It will be appreciated that the invention could be applicable to other situations where a work head projects onto a work surface at non-normal incidence and the gap between the two varies; for example, a laser beam writing obliquely onto a non-flat surface, or the inspection of a non-flat surface with an inclined microscope. Furthermore modelling of the table height variation may be applicable to other applications where the shape of a work surface or the gap between a work surface and a work head varies.

In a further aspect, the invention provides an inkjet printer comprising:

- a print carriage mounting at least one print head, and a print table, the print carriage and the print table arranged to be movable with respect to each other in a printing direction along a plurality of print lines;
- an encoder for providing a position signal indicating the position of the print carriage at least in the printing direction; and
- a compensation system arranged to process the encoder signal based on a local measure of the print gap.

The compensation system may comprise a data store for storing a model of the variation of print gap topography across print area with variation of at least one parameter, apparatus arranged to obtain the value of the or each parameter, and a processor arranged to compensate for variation of the print gap based on the stored model and the value of the parameter.

The processor may compensate for variations in the print gap using a working measure obtained by the method according to the third aspect of the invention.

The invention also provides, in a further aspect, software and/or firmware for an ink jet printer comprising a data store for storing timing compensation values based on the local position of the printer carriage, and apparatus for processing an encoder pulse of the printer carriage using the timing compensation values.

According to a further aspect the invention provides a method of processing a work surface using a work head traversing the surface, comprising varying the timing of the processing dependant upon a local measure of the gap between the surface and the work head.

The invention also provides an ink jet printer comprising a compensation system for carrying out the method of the invention.

In order that the invention may be more readily understood, reference will now be made, by way of example, to the accompanying drawings, in which:

FIG. 2 is a block diagram of logic suitable for implementing the method shown in FIG. 1;

Figure 4:
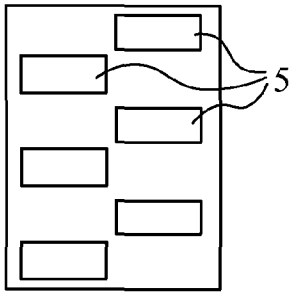
FIG. 4 is a schematic underneath view of the print heads of FIG. 3.
Figure 3:
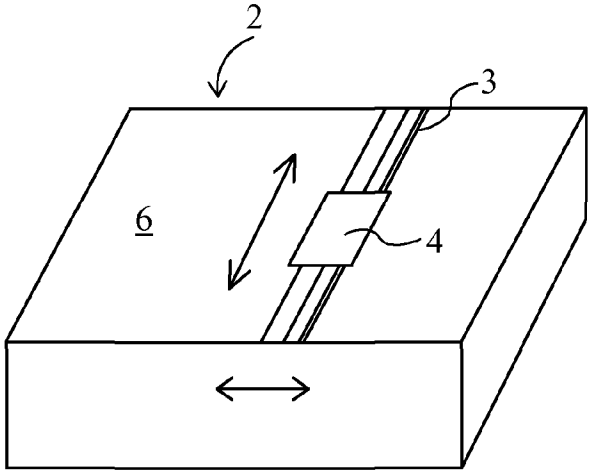
FIG. 3 is a schematic perspective view of a printer suitable for use in accordance with the method of the invention.

Referring to FIGS. 3 and 4, it is well known for an ink jet printer 2 to comprise an encoder 3 producing a sequence of pulses for monitoring the position of the printer carriage 4 which mounts the print heads 5 with respect to the print table 6 or substrate which is mounted on the table. In this example, the printer carriage moves over the print table, but in other arrangements the print head or heads may be stationary whilst the print table is moved. Reference to the print heads traversing the print table is intended to include either arrangement or a combination of both.

The encoder position is used to send print data to the print head according to the image required to be printed. The release of the ink droplets as the print heads lay down a pass of print is controlled by electronic hardware which is fed a signal from the linear encoder reporting the position of the print heads relative to a reference position. Alternatively a stepper motor may be used to drive the print carriage, in which case the stepper motor pulse train may be used to indicate position, and reference hereinafter to an encoder pulse includes such a drive pulse or signal derived from such a drive pulse.

Figure 1:
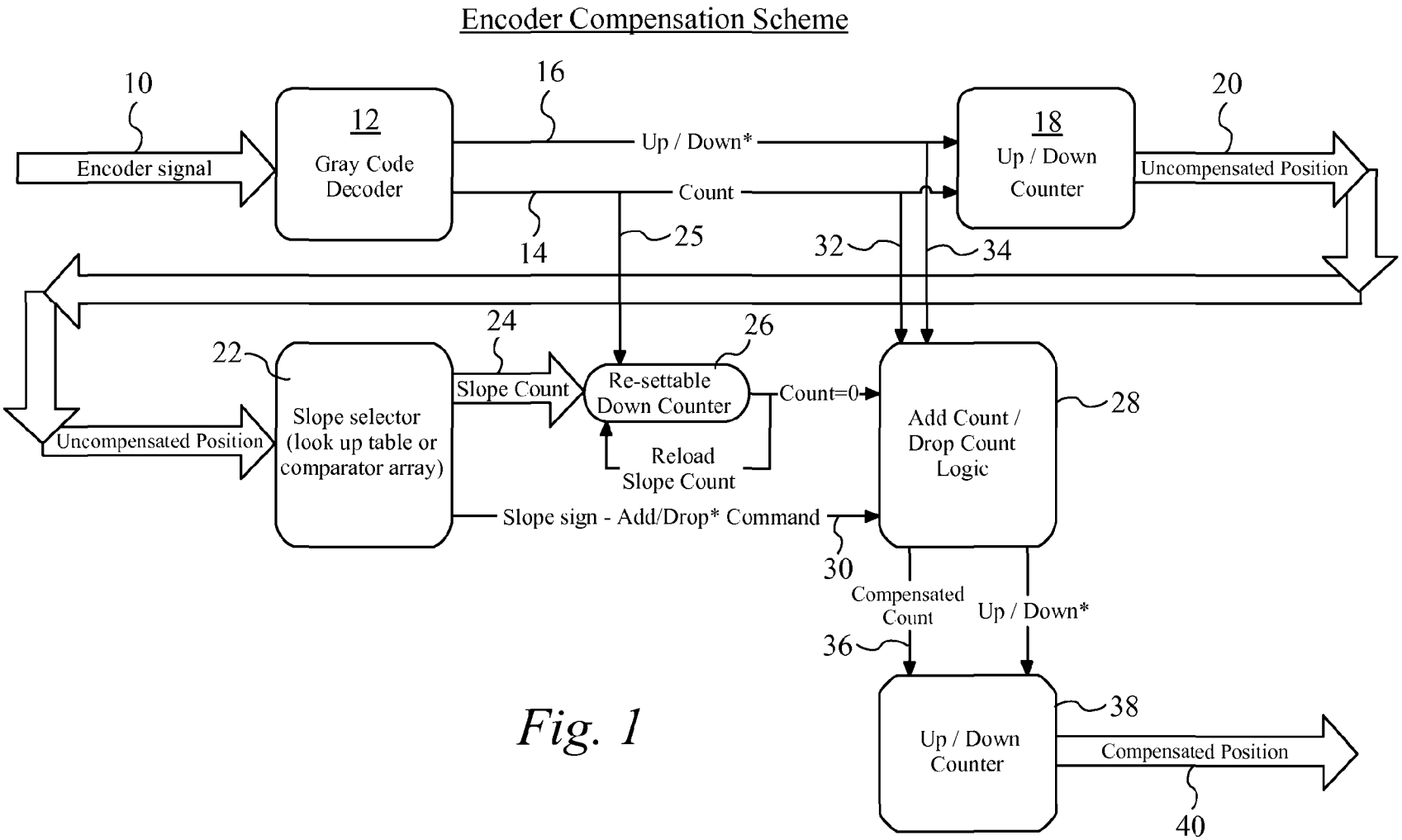
FIG. 1 is a block diagram showing a method according to one embodiment of the invention.

Referring now to FIG. 1, in use of the method of the invention, an encoder signal 10 representing the printer carriage position as it traverses the print area, which may be in Gray code, is passed to a decoder 12 to produce a count signal 14 and a direction signal 16. The count signal represents the linear position of the print carriage along the printing direction, and the direction signal indicates which way the carriage is travelling across the substrate, which will be referred to as either 'up' or 'down'. These signals pass to a counter 18, which outputs an uncompensated position 20, which according to the prior art is then used to control the output of data to the print heads for printing the required image.

Figure 5:
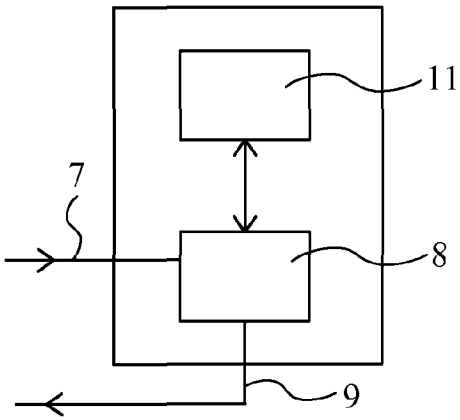
FIG. 5 is a block diagram showing a compensation module for implementing the method according to the invention.

According to the invention, this uncompensated position is adjusted by processing the encoder pulses depending on the variation of the print gap or print table height, to give a compensated position for use in controlling the print heads. Referring to FIG. 5, the encoder pulse 7 is processed by a compensation module 8 to produce an adjusted or compensated encoder pulse 9. The compensation module obtains a compensation value from a data store 11 depending upon the encoder position, and applies the compensation value to alter the encoder pulse.

For example, referring to FIG. 1, the uncompensated position is passed to a slope selector 22 to determine a slope count 24. The slope count is representative of the rate of the change or gradient of the print gap at that position; for example if the slope is steep then the slope count is small, and vice versa. The slope count may be derived from the height run-out of the print table in the printing direction, for example in meters per meter, which is scaled by the ratio of the ink droplet velocity to the print speed (the speed of movement of the print carriage), which ratio represents the angle of the droplet trajectory relative to the table, to give the slippage factor. The reciprocal of this gives the slope count for each slope region, which serves as a compensation value and can be loaded in to the control system.

Where the print table has been mapped in advance of printing, the slope selector can use a simple look up table to find the slope count at the relevant position along the printing line, for example using the higher significance bits of the uncompensated position. Conveniently, the measured variation in print gap or table height can be modelled for example to give a number of approximated slope regions with end points (eg five regions) along each print line, using a known method. One such method minimises the squared difference between a piece-wise linear fit and the actual profile. In other words, the height of the table or substrate is measured as a function of position, and a set of piecewise linear approximations to the surface is fitted to the measurements by standard regression techniques. Thus when printing a particular print stripe, interpolation is used to create a set of coefficients appropriate to the stripe position and the data fed to the control electronics.

The slope selector can use a comparator array to select a slope count by determining in which slope region the uncompensated position lies. The slope count 24 is loaded into a slope counter 26, which counts down triggered by an input 25 from the encoder count signal 14. Each time the slope counter 26 reaches zero, the slope count 24 is reloaded into the slope counter. Also when the slope counter reaches zero, a count pulse is either deleted or added to the uncompensated position count. Thus for example when the slope is shallow, the slope count is high, and the down counter counts down to zero infrequently, so few counts are added or removed. A small slope count leads to a greater rate of addition or deletion of counts.

Whether a count is deleted or added is dependent upon whether the slope is positive or negative, and the encoder count direction, which together show whether the print gap is increasing or decreasing. This is determined by an add/drop logic circuit 28 which receives an input 30 from the slope selector 22 comprising an add or drop command, depending on the sign of the slope, and inputs 32 and 34 representing the encoder count and whether the count is up or down.

Thus a compensated count 36 is produced to drive an up/down counter 38 which generates the compensated position 40. The compensated position is used in place of the uncompensated position to control the output of data to the print heads.

For example, where the slope is such that the print gap is increasing as the print carriage moves along, counts are added so that the print head releases the ink droplets slightly earlier. The further the print heads move, the more counts are added, as the larger the gap gets, and the earlier the ink is released. This compensates for the increasing time of flight of the ink droplets to reach the substrate as the print gap increases. In other words, the compensated position count is increasing more quickly than the real position. When the print head moves back over the same slope in the opposite direction, the gap is getting smaller, counts are dropped, and the ink release is delayed in a similar fashion.

Figure 7:
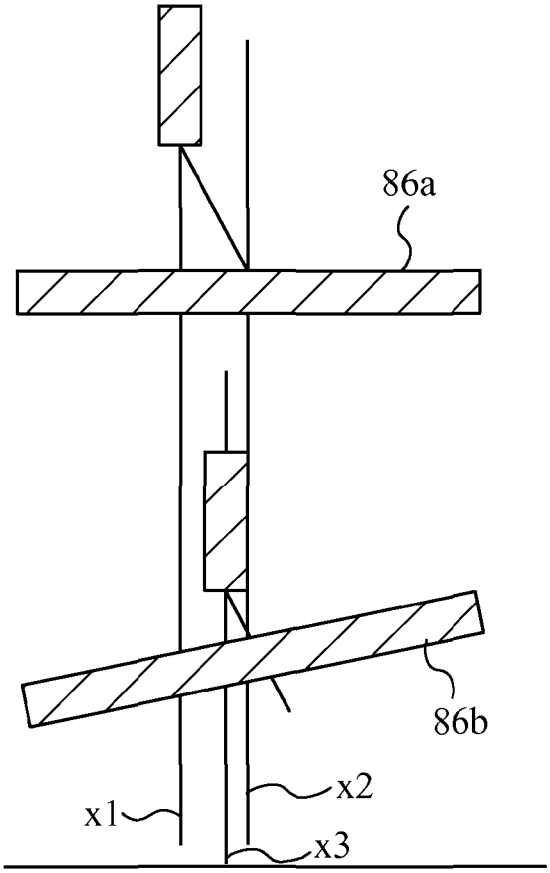

Referring to FIG. 7 for example, it can be seen that an ink droplet released when the encoder reads a value X1 lands at position X2 when the substrate 86*a* is flat. However when the substrate 86*b* is sloping such that the print gap is getting smaller, the ink droplet which is to land at position X2 needs to be released when the print carriage is further along at actual position X3 because of the shorter flight time of the ink droplet. Thus the compensated encoder counts up less than one count per actual encoder count so that the ink release trigger point X1 is only reached when the print head has reached the actual position X3.

Figure 6:
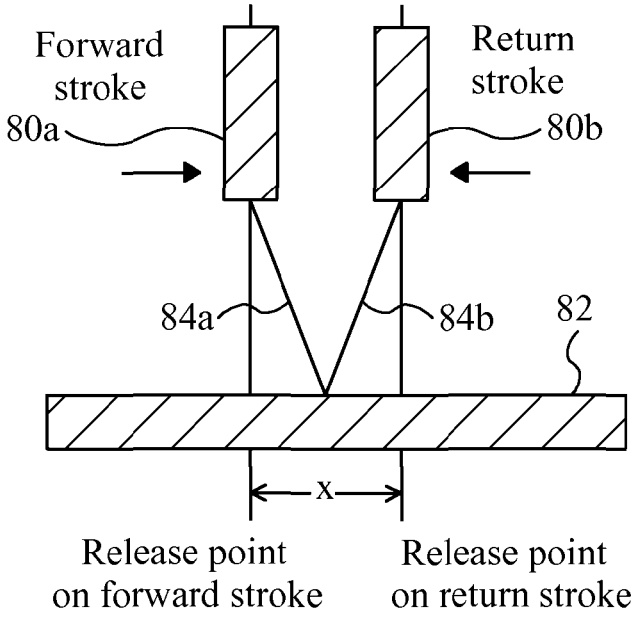
FIGS. 6 and 7 are diagrammatical cross-sections of a print head and substrate.

When printing bi-directionally, conventionally a fixed offset between the release positions in the forward and backward (or up and down) print directions is applied for all positions on the image so that the droplets printed are in registration. FIG. 6 shows the droplet trajectory 84*a* when the print carriage 80*a* is moving in the forward direction, and the trajectory 84*b* when the carriage 80*b* is moving in the backward direction. It can be seen that the release points for droplets to land in the same position on the substrate 82 are offset by a distance x.

Where printing is bi-directional across a sloping surface as described above, it will be appreciated that in the compensated position encoder counts will be added when printing in one direction and removed when printing in the other direction. Thus the image is shorter in terms of unadjusted encoder counts in one direction than in the other. In order that the print data for each direction remain in correct registration, the start position of the out and back print strokes can be adjusted to account for the difference in apparent length. This may be done by adding or deleting an appropriate edge offset value to the encoder position at the beginning of each print stroke.

Thus using knowledge of the nominal print gap, print speed and droplet velocity the required coefficients for the encoder count modification, and the offsets between forward and backward strokes are generated and used to produce the appropriate compensated encoder count.

Referring now to the circuit of FIG. 2, a quadrature encoder 42 sends a signal to a gray decoder 44. The output from the decoder 44 passes to an up/down counter 46 to give a quadrature count 48. Table mapping registers provide an edge offset 50 to give an offset quadrature count 52. The mapping registers also provide print gap data in the form of table position values 54 with associated gradients 58 for each direction 56. An array of comparators 60 is used to select the applicable table zone to provide the applicable gradient or compensation value to the rolling counter control logic 62. The rolling control logic 62 provides a carry/borrow signal to a finite state machine 66, which provides the current state to compensated counter control logic 68. The control logic 68 provides a compensated count 70 via a further up/down counter 72.

The encoder compensation as described above necessarily is applied to all of the print heads regardless of their position on the print carriage, since there is a single encoder position for the print carriage. Since the print carriage has a finite width, the print heads 5 may be mounted in different positions across the width of the carriage 4, orthogonal to the print direction 15, known as the nozzle direction 13 (see FIGS. 3 and 4). It is possible to carry out a further correction adjustment for each print head depending upon their relative positions on the print cartridge. This adjustment can be carried out by applying a correction offset to each print head dependent upon where each print head is located, and the print gap variation in the nozzle direction. In a similar manner to that described above, the variation in the print gap can be scaled by the velocity ratio of the ink droplets to print speed to give offset values for each print head. Thus print heads which are in a position where the print table is lower may fire earlier in order that the ink droplets arrive in the correct position, and vice versa.

In some applications, such as in large format printers, the print head array may span substantially the entire width of the printable area. The encoder position compensation necessarily affects all print heads across the width. Thus a correction factor needs to be applied dependent upon the print head position in both the print direction and the nozzle direction.

Furthermore in such printers the large table area and the significant power output from the curing lamps can lead to significant thermal expansion and ensuing distortion. It has been found that table height variation due to such factors can in some circumstances be modelled as a separable function of the print direction, position, x, and the nozzle direction position, y. That is, the height variation can be modelled as $h(x, y)=f(x)+g(y)$, where f and g are both functions of different position variables. In such circumstances, the corrections for print gap variations in the print direction can be made by the insertion or deletion of encoder pulses and the corrections for print gap variations in the nozzle direction can be made independently by adjusting the timing of the printhead firing based upon its position in the nozzle direction. This technique can be conveniently applied when the print head array covers the entire, or a substantial part of, the printable width.

On machines having a printhead array which is short in the nozzle direction in comparison with the printable width of the substrate (as measured in the nozzle direction), the print gap need not be modelled as a separable function as interpolation can be used for each print swath in order to represent the print gap as $h(x,y)$.

It has been surprisingly found that conveniently, in certain printer arrangements, height variation due to thermal expansion can be reasonably well approximated by assuming a constant radius of curvature. Thus a representation of the table topography may be obtained by measuring the height of the table at a reference location. This is found to be convenient for some particular physical arrangements but, for the avoidance of doubt, the invention is much more generally applicable to printing arrangements where this an approximation does not usefully apply. More generally, in a given arrangement, there may be another approximation that gives a useful simplification and the invention generally provides adjusting timing based on a model of variation. The model may be mathematical or approximated by a lookup table or a combination, with whatever precision is required for the application; it has been appreciated that even correction based on a crude simple model which has not been calibrated to a specific printer may in practice be significantly better than an uncompensated prior art arrangement.

Thus under certain circumstances, a single parameter (such as the height measured at a particular point on the table) can be used to calibrate an underlying model of the table distortion and thus table height at any given position. For example, in such a case, if we measure the table height H, at position X,Y, and we assume a model of the distortion of the form $h=A*(xA2+yA2)$ or a similar approximation, then the parameter A is determined and we can estimate h at any point at the time the height measurement was taken.

The height variation may also vary over time, for example due to the table heating up with use. If the distortion varies sufficiently slowly with time, it may not be necessary to measure the height directly—a simple adjustment of the scaling parameter ("A" in the above formula) by the machine operator may be sufficient to achieve adequate compensation. In other words the form $h(x,y,t)=A(t)*(xA2+yA2)$ may be suitable for some applications. In use, the measure of deflection at a point, or some other measure or combination of measures such as the temperature difference across the table, or energy flux measure or time of use or a measure of strain at a point may be used to derive an operating parameter. Values of A(t) can for example be obtained by taking measurements and interpolating therebetween.

A method of determining the topography of a print area will now be discussed in more detail. In this method, parameters relating to the printer, such as the environmental temperature or humidity, the operating time for the printer or the recent duty cycle for the printer are noted and a calibration image, or test image, is printed on the printer. The test image is preferably an image for which the positioning of the image elements can be accurately calculated or measured assuming the image is printed with a constant print gap. In practice, for ease of calculation, an image comprising a regular pattern of dots or ticks may be used.

In the present embodiment, the test print consists of two passes, one forward and one backward and the full width of the table is covered. The pattern is essentially a line of ticks from each print head, the spacing of the ticks between the forward and backward passes depends on the print speed, the jet velocity and the gap between the head and the substrate. The pattern is repeated down the table, so that separate values can be measured in the x direction. In practice, it has been found that just 5 positions are needed along a 3*m* table.

The test pattern is printed twice, at two different print heights, with a small offset so that the patterns are not mixed together. Although the absolute value of the print gap is unknown, the difference in the print gap between the two prints is accurately known, because this is the mechanical z axis. So for each print head and at each position down the table, we get two measurements of tick separation at two different print gaps, where we know the difference between the two print gaps. We assume the jet velocity is constant between the two prints, this allows us to use simultaneous equations to find the jet velocity for the head and the actual print gap for that head.

In some embodiments, this data may be used to calculate the print gap and velocity for each nozzle, different compensation values may then be applied to each nozzle in the print head.

However, in an advantageous embodiment, values for all the nozzles in a head are averaged, which reduces measurement noise.

Once the jet velocities for each head are known, the print gap can be measured for each head from a single bidirectional print. When measuring the shape of a heat distorted table, a single bidirectional print is printed while the table is still hot from blank passes. The print total time is short, around 5 seconds, so the table will not have distorted much between the two passes. Scan time is less important, as the image is now fixed on the substrate.

Each test image may be analysed using a scanner to determine variations in the test image caused by print gap variations. In a preferred embodiment, the scanning is performed using a Contact Image Sensor attached to a moving carriage, optionally the print carriage. The sensor is then scanned across the table while the table and printed test image is stationary. LED light sources close to the scanner array are used to provide illumination. An image can therefore be built up that is the width of the scanner (around 20 cm) and a length corresponding to the width of the table, Using red, green and blue LEDs enable the system to capture colour data, so the test image may be printed in colour using several different printheads or nozzles. This may enable the system to distinguish between different inks and to maximise image contrast for a given ink colour.

Where a handling mechanism other than a table is used, other corrections may be used. For example, where a substrate is passed between rollers, a measure, or model or approximation of varying amounts of sag between the rollers or support points may be applied in addition to measure of variation along the axis of the rollers, and again the print gap may be a separable function of x and y position.

In an embodiment ink jet printer, where there is relative movement between a print carriage and a print table to print on to a substrate mounted on the table, the gradient of the print table at each position of the print carriage is used to produce a compensated position of the print carriage, and printing data is sent to the print head according to the compensated position instead of the actual position. This delays or advances the release of ink, to compensate for the difference in the time taken for the ink to reach a substrate mounted on the print table when the print gap between print heads and print table is not constant.

As noted above, in the 2 dimensional plane of the print table, the print direction (the direction in which the print carriage moves in a scanning printer) may be represented by an x axis, and the axis perpendicular to the print direction, which may be termed the nozzle direction, may represent the y axis.

In a scanning printer where the carriage moves over most of the substrate area, an individual print head will need to be compensated for a large range of y values, however any given pass is at only one value of y, so a different compensation value can be used for each pass to accommodate the variation of print gap with y.

In a full width printer, where the print carriage spans the whole width of the substrate, many different gap values occur in a single pass, however the carriage is made up of many printheads, and each individual printhead only covers a small range of y values, so it is relatively easy to use different gap values for the different individual heads in the array. As with the scanning type machine, heads may move in y between passes, and of course this is accommodated by loading different compensation values on different passes depending on head position.

It is common for data to be clocked to all printheads synchronously, so it is convenient to apply a single x dependent compensation to all printheads. If the depth of the print carriage is large, it may be necessary to provide different compensations to different heads within the carriage, this can still be done using the techniques described above, but would require more processing to cope with the multiple channels.

A more flexible approach is to modify the print data for each printhead to compensate for variability of the gap in position and time. This approach requires a lot of data processing, but does mean that any kind of distortion can be compensated. The limit of compensation in this scheme is a single pixel, this can be made small by choosing to print on a very fine print grid. This results in a higher data rate for the print data being needed, and further adds to the processing burden. As data processing rates go up, this approach will become more attractive.

It will be appreciated that the techniques disclosed herein may be used together in an ink jet printer, or separately, and in other applications and all features disclosed herein may be provided independently unless otherwise expressly stated.

The invention claimed is:

1. A method of providing a working measure of the topography of a work surface comprising:

storing at least a first and second representations of the topography corresponding respectively to first and second conditions, wherein each condition has a plurality of associated parameters, and wherein the two-dimensional topography of the work surface changes between the first and second conditions;

obtaining the value of at least one associated parameter, comprising obtaining the value of the at least one parameter corresponding to at least first and second regions of the work surface respectively, and interpolating between the regions; and providing the working measure based on the obtained value of the parameter and the stored representations of the topography.

2. The method as claimed in claim 1 comprising providing the working measure to a control system for an ink jet printer comprising at least one print head and using the working measure to control the timing of the release of ink from the print head.

3. The method as claimed in claim 1 wherein the work surface comprises a print substrate or a substrate support.

4. The method as claimed in claim 1 wherein the working measure of the topography of the work surface is selected from the group comprising:

a measure of a print gap between the work surface and a print head; and a measure of a variation in height over a two-dimensional area.

5. The method as claimed in claim 1 further comprising using the working measure of the topography of the work surface to create a two dimensional array of compensation values and applying the compensation values to a work head traversing the work surface.

6. The method as claimed in claim 5, wherein the compensation values comprise timing compensation values for controlling the operation of a print head traversing the work surface.

7. The method as claimed in claim 1, in which the obtained value of the parameter is a measured or derived value or an input value.

8. The method as claimed in claim 1, in which the parameter is a measure of temperature, humidity, energy flux, height at a reference position or operation time.

9. The method as claimed in claim 1, in which each representation of topography is obtained by taking measurements of the work surface at one or more reference locations.

10. The method as claimed in claim 1, in which interpolation is used between the stored representations of the topography based on the obtained value of the parameter to provide the working measure of the topography.

11. A method of providing a working measure of the topography of a work surface comprising:

storing at least a first and second representations of the topography corresponding respectively to first and second conditions, wherein each condition has a plurality of associated parameters, and wherein the two-dimensional topography of the work surface changes between the first and second conditions;

obtaining the value of at least one associated parameter; and providing the working measure based on the obtained value of the parameter and the stored representations of the topography, wherein each representation of topography is obtained by:

printing a calibration image onto the work surface;

analysing the printed calibration image to compare the printed calibration image to an expected image; and calculating a variation in the topography of the work surface based on a difference between the printed calibration image and the expected image.

12. Apparatus for compensating for print gap variation in an ink jet printer comprising:

logic for performing a method of providing a working measure of the topography of a work surface, the method comprising:

storing at least a first and second representations of the topography corresponding respectively to first and second conditions, wherein each condition has a plurality of associated parameters, and wherein the two-dimensional topography of the work surface changes between the first and second conditions;

obtaining the value of at least one associated parameter comprising obtaining the value of the at least one parameter corresponding to at least first and second regions of the work surface respectively, and interpolating between the regions; and providing the working measure based on the obtained value of the parameter and the stored representations of the topography, wherein a plurality of said working measures are provided, said working measures comprising local measures of print gap, based on an obtained parameter relating to the printer operational condition; and logic for adjusting the timing of ink release from print heads of the printer based on the local measures.

13. An inkjet printer comprising:

a print carriage mounting at least one print head, and a print table, the print carriage and the print table arranged to be relatively movable in a printing direction along a plurality of print lines;

an encoder for providing a position signal indicating the position of the print carriage at least in the printing direction; and a compensation system according to the apparatus of claim 12, the compensation system arranged to process the encoder signal based on a local measure of the print gap.

14. The inkjet printer as claimed in claim 13, wherein the compensation system comprises a data store for storing a model of the variation of print gap across print area with variation of the at least one parameter, apparatus arranged to obtain the value of the or each parameter, and a processor arranged to compensate for variation of the print gap based on the stored model and the value of the parameter.

* * * * *